US006152672A

United States Patent [19]

Alson

[11] Patent Number: 6,152,672

[45] Date of Patent: Nov. 28, 2000

[54] SEGREGATED HAZARDOUS WASTE CONTAINER SYSTEM

[76] Inventor: William B. Alson, 2340 Windchime Dr., Jacksonville, Fla. 32224

[21] Appl. No.: 09/285,165

[22] Filed: Apr. 1, 1999

[51] Int. Cl.[7] ..... B65D 91/00

[52] U.S. Cl. ..... 414/406; 220/523

[58] Field of Search ..... 280/33.998; 414/406, 414/407, 408, 409; 220/507, 522, 553, 909, 523

[56] References Cited

U.S. PATENT DOCUMENTS

| | | |
|---|---|---|
| 581,322 | 4/1897 | Winters . |
| 1,281,587 | 10/1918 | Kovachevich . |
| 3,893,615 | 7/1975 | Johnson . |
| 4,984,704 | 1/1991 | O'Malley . |
| 5,015,142 | 5/1991 | Carson . |
| 5,015,143 | 5/1991 | Carson . |
| 5,098,250 | 3/1992 | Carson . |
| 5,171,119 | 12/1992 | Carson . |
| 5,297,481 | 3/1994 | Robbins et al. . |
| 5,377,907 | 1/1995 | Guard . |
| 5,511,687 | 4/1996 | Garret, Jr. et al. . |
| 5,547,097 | 8/1996 | Lyon . |

*Primary Examiner*—Richard M. Camby
*Attorney, Agent, or Firm*—Gunster, Yoakley & Stewart, P.A.

[57] ABSTRACT

A waste container system comprising: at least one enclosed treatment carts including a plurality of wheels disposed therefrom for rolling the treatment cart, wherein the treatment carts have at least one sealed door to allows waste to be placed inside the treatment carts wherein at least one of the treatment carts is capable of being treated by a treatment process without having to first empty the contents of the treatment cart prior to the treatment process; and a transport container capable of being transported by a tractor trailer with an open top side and at least one opening in a side wall covered by a door wherein the transport container is capable of receiving one or more treatment carts through the opening.

In accordance with another embodiment of the present invention, a treatment cart is capable of being treated by a autoclave process, or a microwave process or a chemical sterilization process.

11 Claims, 6 Drawing Sheets

SEGREGATED HAZARDOUS WASTE CONTAINER SYSTEM

CROSS-REFERENCE TO RELATED APPLICATIONS

Not applicable

BACKGROUND OF THE INVENTION

1. Field of the Invention

The invention disclosed broadly relates to the field of containers for waste, and more particularly relates to the field of containers for waste storage, waste transportation and waste treatment for hazardous waste.

2. Description of the Related Art

Waste that may be dangerous to the environment is called hazardous waste. The term environment broadly refers to all life including plants, animals, and humans that may be harmed by hazardous waste. Government regulation from local, state and federal governments for the safe handling of hazardous waste continues to grow. Companies must respond to these increasing government regulations. One type of hazardous waste is known as biohazardous waste. Biohazardous waste is waste from hospitals, medical clinics, medical laboratories and a other medical facilities that includes infectious waste, chemotherapeutic waste and pathological waste comprising used needles, used bandages and used dressings, used medical devices, human fluids and human tissues. One method medical facilities dispose of biohazardous waste is to segregate the waste by placing it into red plastic bags. Red is a common color in the medical industry to signify biohazardous waste. Red plastic bag sizes are available from 2 gallons sizes up through 20 gallons sizes. Biohazardous waste many times is not only infectious with viruses such as hepatitis or the AIDS, but is often times in containers such as needles and bottles with sharp edges that tend to puncture the red plastic bags.

The red plastic bags are collected at medical facilities from specialized containers and thrown into a speciality marked dumpster. These dumpsters, called roll-off containers are typically 8 foot wide, 22 feet long with a top cover and have a capacity of 38-cubic yards to 40-cubic yards. The roll-off container may have a side door and rear door to enable medical facility staff throw-away the collected red plastic bags. A specifically designed truck picks up the roll-off container and brings the roll-off container when filled to a biohazardous waste processing facility. The roll-off container is dumped at the biohazardous waste processing facility. The red plastic bags are gathered using a combination of manual and automated separation. This process of gathering the red plastic bags at the treatment facility although efficient, is not without its shortcomings.

One shortcoming is that the individual red plastic bags are subject to breaking and exposing their content because of the extensive handling. The extensive handling includes the process of throwing or dumping the individual bags into the roll-off. The red plastic bags are subjected to the process of trucking to the waste treatment plant. The trucking process causes shifting, vibration and compaction of the red plastic bags under other bags. Because of this extensive handling, it is common for a broken red plastic bags to break and spill their hazardous contents into the roll-off container. A broken bag which exposes the biohazardous waste to employees and staff of the waste treatment facility is dangerous. Accordingly, a need exists to provide a container that greatly reduces and perhaps even eliminates completely the exposure of biohazardous contents of plastic bags that may have broke and spilled their contents prior to being processed at the a biohazardous processing plant.

Another shortcomings with the use of roll-off containers is the need to repack the biohazardous waste into containers for waste processing. There are several different types of treatment of biohazardous waste. One treatment is called autoclaving, where the biohazardous contents of the plastic bags are treated with heat such as steam at temperatures up to 500 degrees Fahrenheit. The contents of the roll-off container which is composed of plastic bags still in tact, (i.e, not broken) and broken or punctured plastic bags that have their biohazardous contents exposed. These broken bags, their contents and non-broken bags are places into treatment containers. For the treatment process of autoclaving, speciality designed leak-proof steel containers are used. Other processes for the treatment of biohazardous waste includes microwaving and chemical treatments. The type of treatment container for processing the biohazardous material for one process, for example steel autoclaving containers, may not be appropriate to another process such as microwave treatment. The type of processing is therefore somewhat treatment container specific. Accordingly, a need exists to provide a container that can be customized to the type of biohazardous treatment being performed at a waste treatment plant without exposing personnel to the hazardous waste.

Still, another shortcoming with the use of roll-off containers is the difficultly in the storage and transportation of roll-offs. Many counties, states and even governments are shipping waste to be process to different localities. Extending the concept used in the cargo shipping arena, containerized shipping has been used for waste. Containerized shipping uses a standardized container, typically the size of a trailer on a tractor trailer truck, that can moved with a lift or crane from a truck, to a train, to a plane or into a ship. Containerized shipping has greatly reduced the cost of having to unpack and repack goods from one transportation system to another transportation system. In addition, containerized shipping has enable shipping containers to be vertically stacked during transport or storage. The use Sea-Land type containers for transporting and storing hazardous wastes is useful but the problem of having the contents of plastic bags burst open in these containers is identical as in the roll-offs containers described above. The roll-off containers today, have slope roofs that do not allow stacking of the containers. Accordingly, a needs exists for a container that can hold hazardous materials, which can be stacked and moved around from one transportation system to another transportation system like Sea-Land containers without exposing personnel to the hazardous contents of plastic bags.

SUMMARY OF THE INVENTION

Briefly, in accordance with the present invention, a waste container system comprising: at least one enclosed treatment carts including a plurality of wheels disposed therefrom for rolling the treatment cart, wherein the treatment carts have at least one sealed door to allows waste to be placed inside the treatment carts wherein at least one of the treatment carts is capable of being treated by a treatment process without having to first empty the contents of the treatment cart prior to the treatment process; and a transport container capable of being transported by a tractor trailer with an open top side and at least one opening in a side wall covered by a door wherein the transport container is capable of receiving one or more treatment carts through the opening.

In accordance with another embodiment of the present invention, a treatment cart is capable of being treated by a autoclave process, or a microwave process or a chemical sterilization process.

DETAILED DESCRIPTION OF AN EMBODIMENT

Figure 1:
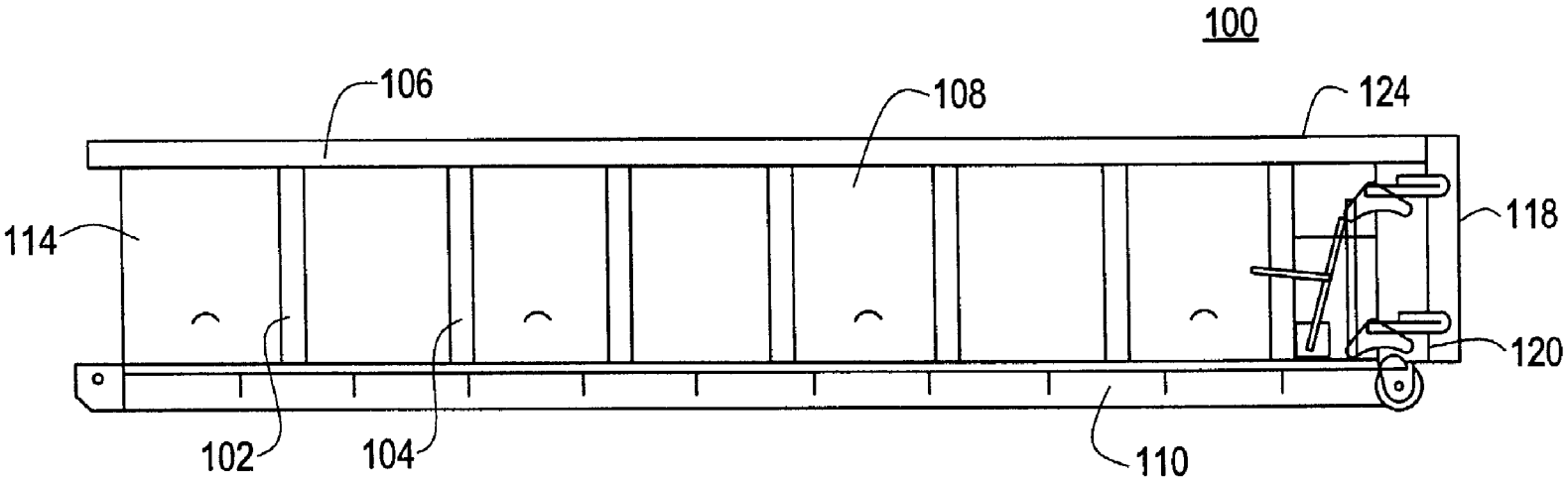
FIG. 1 is a side view of a container of a first embodiment of a roll-off container accordingly to the present invention.
Figure 2:
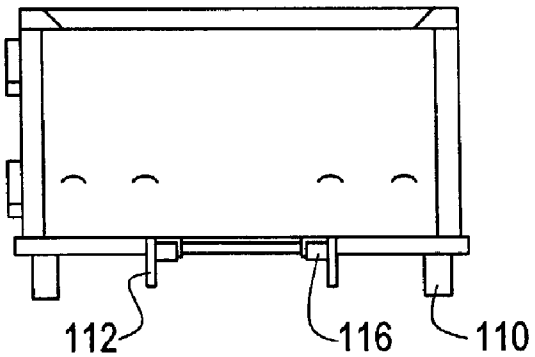
FIG. 2 is a front end view of the container of FIG. 1 according to the present invention.
Figure 3:
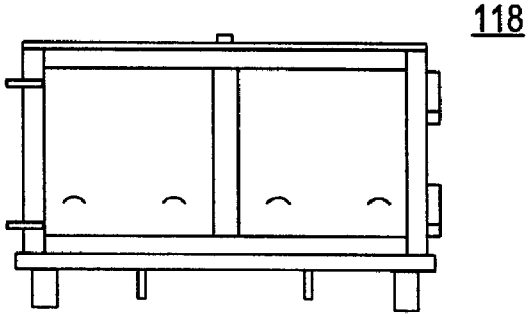
FIG. 3 is a rear end view of the container of FIG. 1 according to the present invention.
Figure 4:
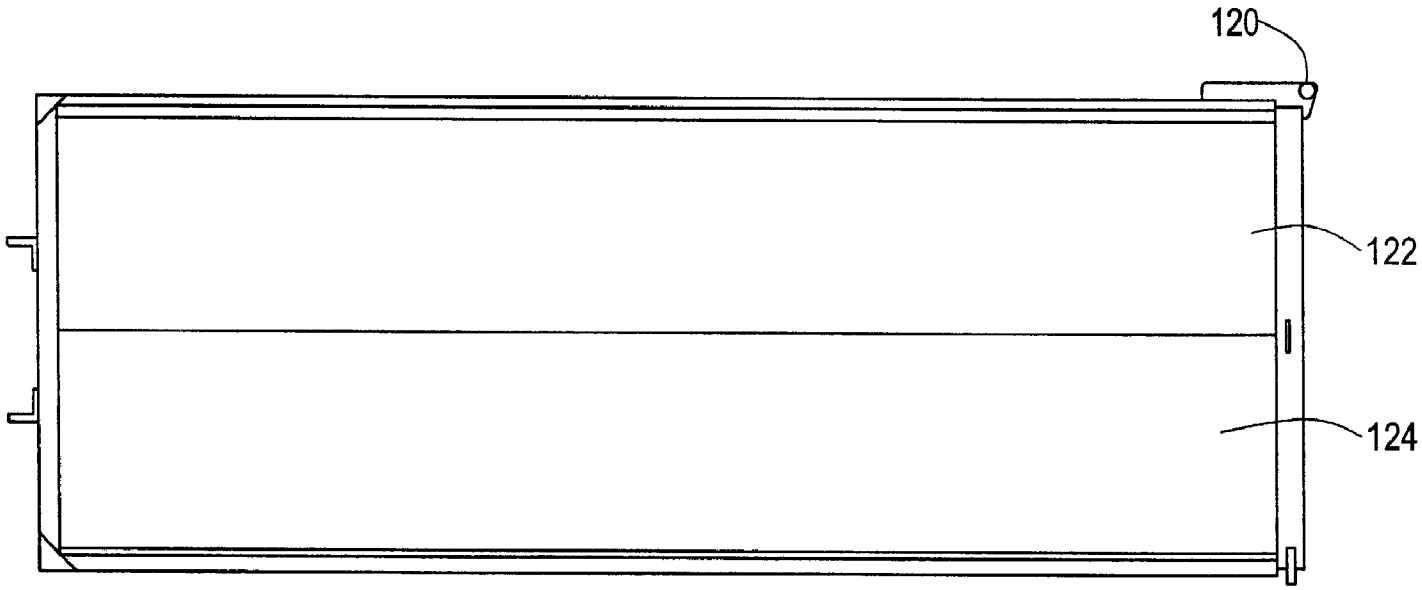
FIG. 4 is a top view of the container of FIG. 1 according to the present invention.

The drawings referred to throughout this specification, use like numerals to refer to like parts throughout several views. Turning now to FIGS. 1–4, there is shown a side view, a front end view, a rear end view and a top view, respectively, of a container 100 of a first embodiment of a roll-off container accordingly to the present invention. The container 100 in this embodiment is a roll-off container. The term "roll-off" is used to described waste dumpsters that can be loaded and unloaded from specifically designed trucks. The container 100 is rolled-off the back of the truck during the loading/unloading operations, hence the name. The roll-off container 100 is constructed from steel and is substantially rectangular in shape. An example roll-off container 100 or dumpster can be found at online URL http://www.veitcompanies.com/rolloff.htm from Veit Disposal Systems of Rogers, Minn. The size of the roll-off container 100 is about 24 feet in length, 8 feet in width and 37 inches in height. These dimensions are chosen to meet government regulations including DOT (department of transportation) guidelines for trucks. But other sizes are possible depending on the exact application and storage capacity required.

The construction of roll-off containers is known to those skilled in the art and the following provides a brief description of the roll-off container 100. The container 100 has rigid framing comprising vertical support channels 102 attached to the floor 104 for supporting a top 124 rim 106. The roll-off container 100 has with an open top and closed walls 108 and a closed floor 104. Heavy gauge sheet forms the walls 108 inside the rigid framing. Two skids 110 running parallel to each other are attached to the floor 104 from the front end 118 to the rear end 114 to allow the container to be dragged to positioned across the ground with a truck. Also attached to the underside of the floor 104, are two guides 112 for centering the container 100 on a disposal truck. A pair of metal wheels 116 attached to the rear end assist the container 100 during the loading/unloading operation onto the disposal truck. A door closing mechanism 120 is shown to open and close the rear door 122 that swings outward to enable to treatment carts 200 (shown in later figures) to be loaded. In another embodiment, container 100 has several side doors (not shown) to allow the loading of the treatment carts 200 in through the side doors instead of the rear door 122.

Figure 6:
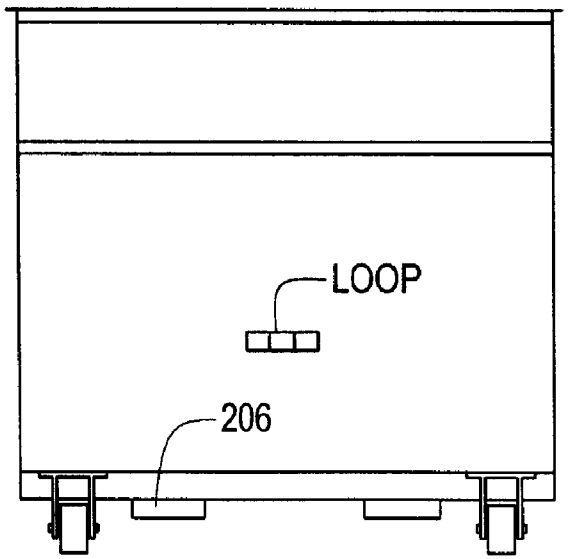
FIG. 6 is an end view of the treatment cart of FIG. 5 according to the present invention.
Figure 5:
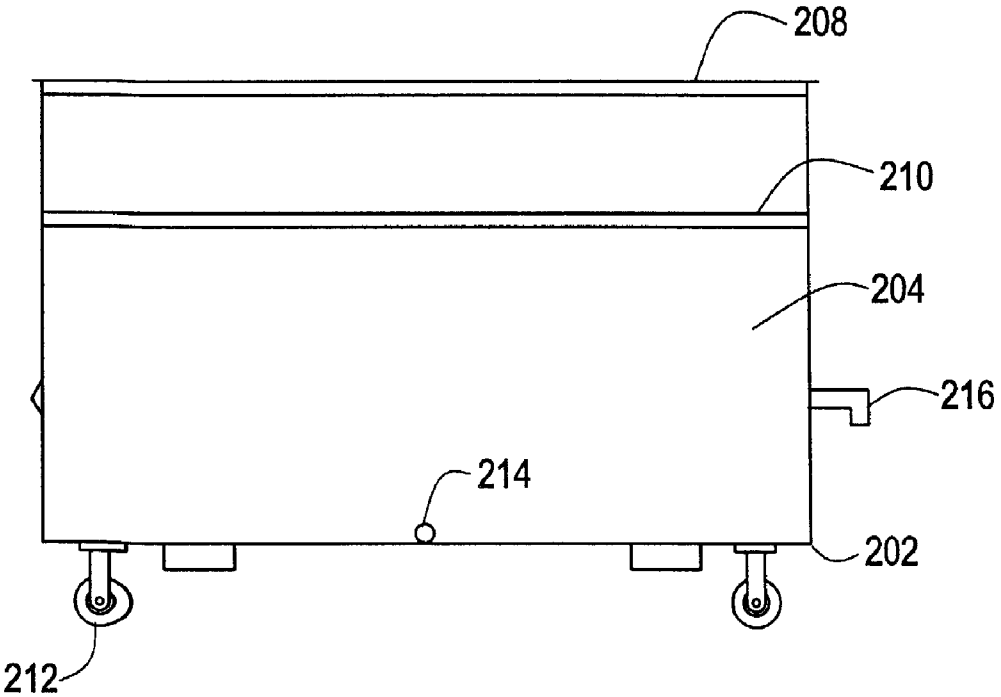
FIG. 5 is a side view of a treatment cart that inserts into the container of FIG. 1 according to the present invention.

Shown in FIGS. 5–6 is a side view and an end view, respectfully, of a treatment cart 200 that inserts into the container of FIG. 1 according to the present invention. The treatment cart 200 is a rectangular cart with enclosed floor 202, enclosed walls 204 and enclosed top 208. For an embodiment where the treatment of the hazardous waste is through the heating process known as autoclaving, the cart is made to with stand high temperatures to 500 degrees Fahrenheit. One material which is durable and can withstand the autoclaving treatment is steel. The treatment cart 200 holds the hazardous waste products (not shown) during storage and transportation to the treatment plant. The treatment cart 200 can be constructed from other materials such as high impact plastics for treatment operations where metal construction is undesirable such as microwaving. In this embodiment, the treatment cart 200 used in a autoclaving process is reenforced steel. A rigid frame 210 is used to support sheet steel walls 204 where the cart seams are joined by weld. The rigid frame is stitched welded to the steel walls 204, steel floor 202 and steel top 208. Four swivel casters 212 such as those available from Colson type #4-4109-13 or equivalent are fasted to the floor 202. The swivel casters 212 must be able to withstand the high temperatures during the autoclaving process when the waste is treated inside the cart 200. A set of channels 206 are formed under the treatment cart 200 to permit a fork-lift to move the cart 200. A drain hole with a plug 214 is cut into at least one wall to enable any liquid that has accumulated in the treatment cart 200 to be drained. The treatment cart 200 is constructed such that it can fit within the container 100. In this embodiment, the treatment cart 200 is about 66 inches long, 47 inches in height including the swivel caster 212 and 46 inches in width. These dimensions are for example only, other dimensions are contemplated for the treatment cart as will be discussed further below. A hook 216 and loop 230 is formed on opposite end of the treatment cart 200 for pulling and joining multiple carts in tandem. Each of the treatment carts 200 are capable of being rolled off the container 100 and placed directly in to a hazardous treatment process such as autoclaving without opening the treatment cart or having personnel at the treatment plant handle individual plastic bags filled with hazardous wastes. The channels 206 allows the entire treatment cart 200 to be picked up and carried around the waste treatment plant for processing. Once the waste is treated, it can by discarded by inverting the treatment cart into an incinerator, landfill or other waste disposal process. It should be understood that the use of the treatment containers 200 now eliminates the need to have personnel handle the hazardous waste in the treatment plant, because even if a plastic bag should rupture during transport to the treatment plant, the personnel is not exposed to the contents prior to hazardous treatment process.

Figure 7:
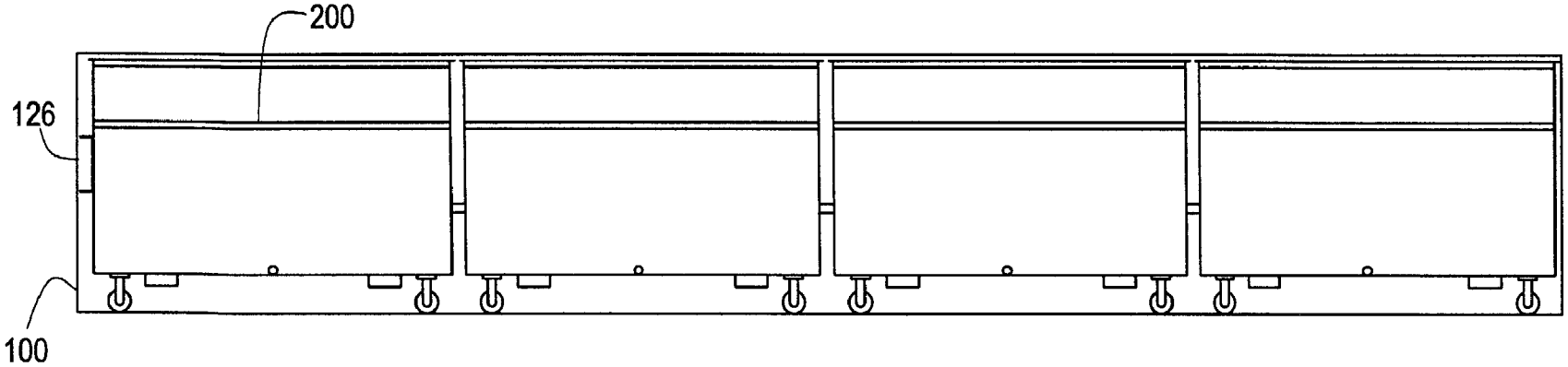
FIG. 7 is a side view of the several treatment carts of FIG. 5 loaded into the container of FIG. 1 according to the present invention.
Figure 8:
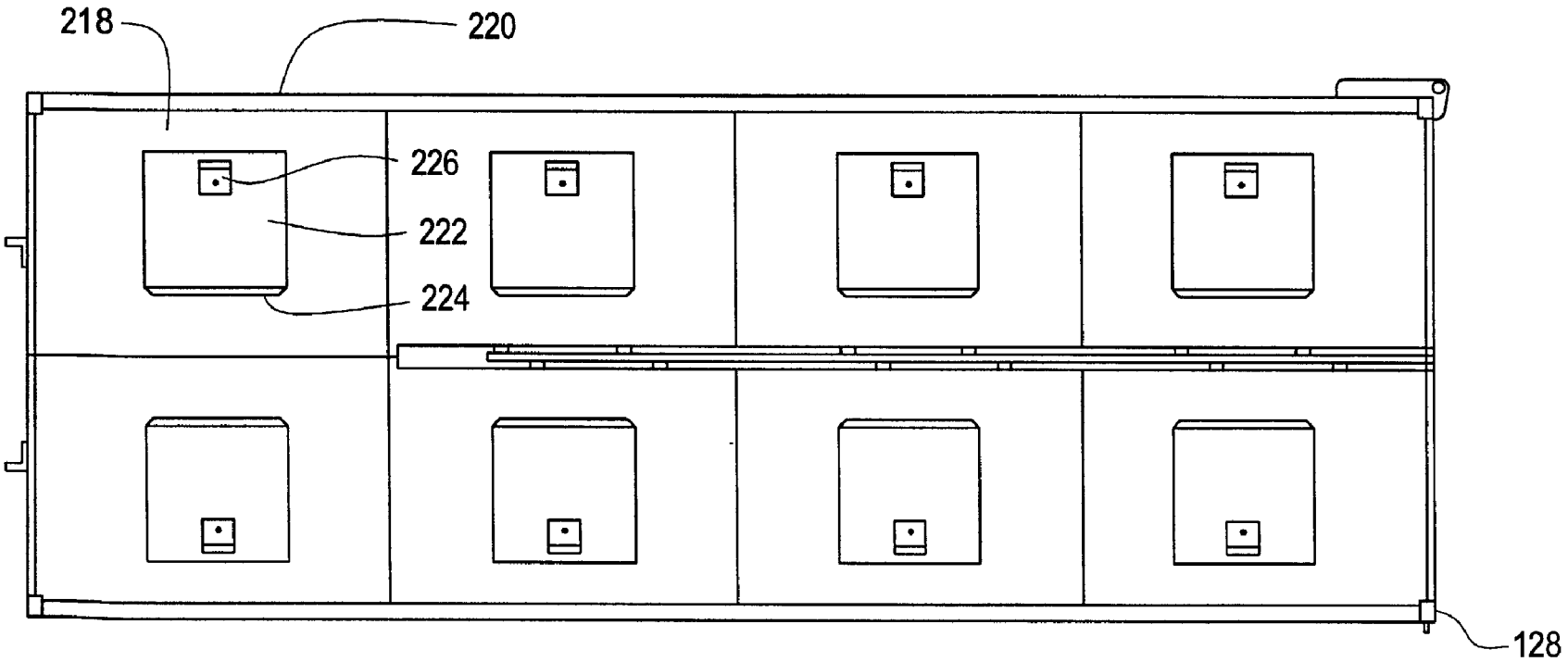
FIG. 8 is a top view of several treatment carts of FIG. 7 according to the present invention.

Shown in FIGS. 7–8 is a side view and a top view, respectfully, of the several treatment carts 200 of FIG. 5 placed inside a container 100 according to the present invention. Shown are eight treatment carts 200 positioned in container 100. Each treatment cart 200 is rolled into the left or right side of the container through door 122. A bumper 126 compresses to firmly hold the treatment carts 200 from shifting when all eight treatment carts 200 are inserted in container 100 so that they do not shift during transportation inside container 100. Each treatment cart 200 can be positioned in place inside the container 100 using a fork lift truck to lift the treatment cart 200 by the set of channels 206. In another embodiment, the treatment carts 200 are coupled to a cable system (not shown) to allow an operator to pull multiple treatment carts 200 inside the container 100. Four treatment carts go in each side of the container. A 2 inch by 2 inch and 6 inch heigh steel stacking bar 128 is fastened to each corner of the container 100 to permit stacking of container 100 vertically, one on top of another. A corresponding recess is formed (not shown) in the bottom of each container 100 to accept the stacking bar when each container is stacked one on top of another.

FIG. 8 illustrates a top view of several treatment carts of FIG. 5 loaded into the container of FIG. 1 according to the present invention. Two doors are placed on the top of each treatment cart 200. The larger door 218 forms the top 208 or lid of the treatment cart 200. The larger door 218 is hinged along one side 220. A small door 222 is hinged along one side 224 and is attached to larger door 218. Larger door 218 permits the dumping of the entire treatment cart 200 when inverted. Small door 222 is used to dispose of biohazardous trash at a medical facility. The small door 222 is lighter than the larger door and can be easily opened with handle 226. Leak proof gaskets or other seals (not shown) are placed around the small door 222 and larger door 218 to seal the cart 200 when the large door 218 and the small door 222 are closed.

Figure 9:
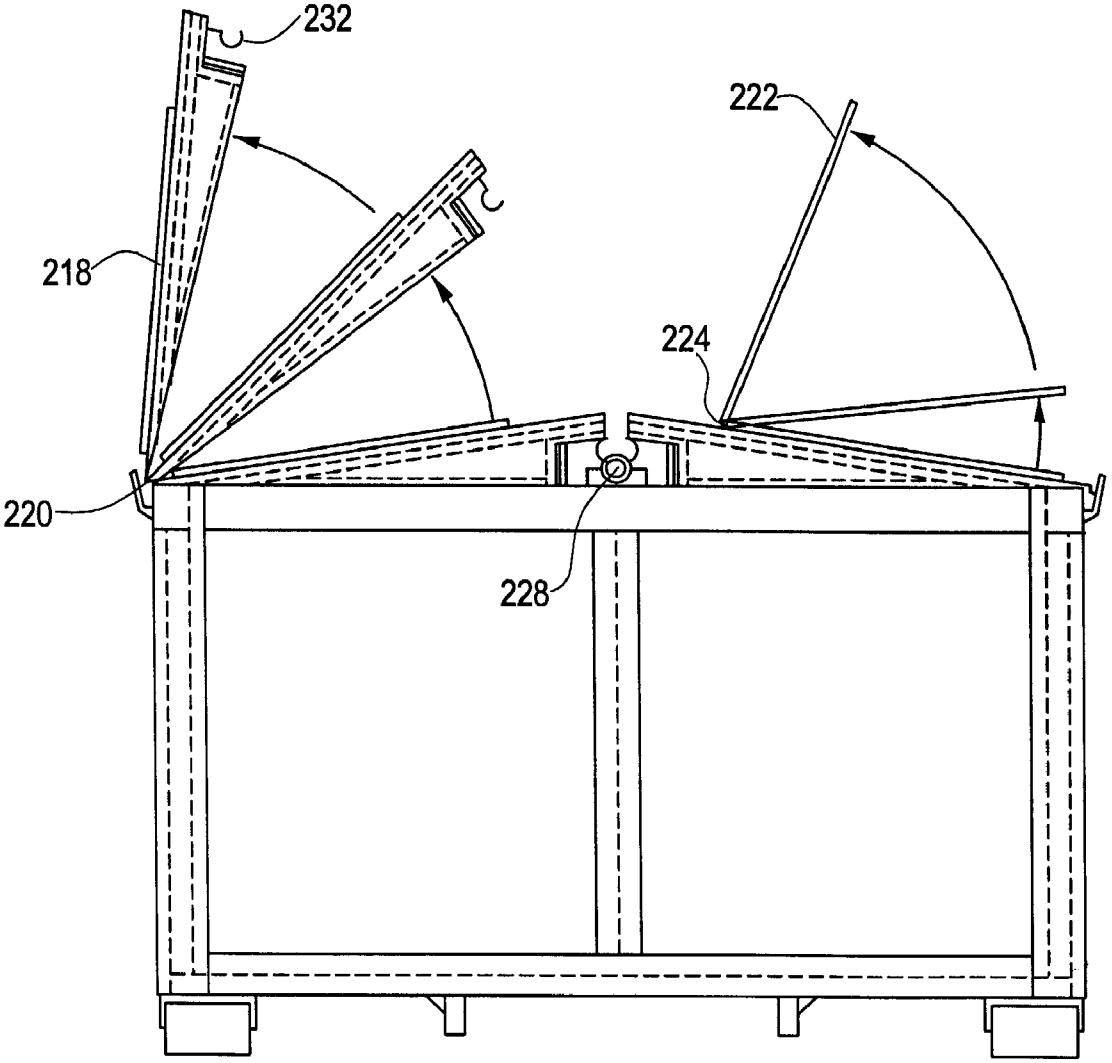
FIG. 9 is a rear view of the container of FIG. 1 detailing the latch for the large top doors and the small top doors according to the present invention.

Shown in FIG. 9 is a rear view of the container of FIG. 7 detailing the latch for the large top doors and the small top doors according to the present invention. A eye-hook or ring 232 holds large door 218 in place via rod 228. It holds large door 218 of each treatment cart 200 closed and secure during transport inside container 100.

In another embodiment, the treatment cart 200 may come in several different sizes so a treatment cart 200 can be delivered to a medical facility based on cubic space. Each of the treatment carts 200 must be sized to roll into the container 100. Having different size carts would enable customers to choose a treatment cart 200 or carts to fit their needs while enabling a single uniform design of container 100 to pick up the treatment carts 200. Moreover, other waste such as general recycling waste of paper, aluminum, glass can be placed in one of the treatment containers while hazardous waste is placed in another cart 200. Each treatment cart 200 would be labeled or color coded to designate the type of waste within, for example hazardous waster versus non hazardous. This would enable on container 100 to pick up pre-sorted materials that comprises hazardous waste, non-hazardous waste and recyclable waste and non-recyclable waste all in one container 100 without exposing personnel to clearly marked hazardous materials.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. A waste container system comprising:

at least one enclosed treatment carts including a plurality of wheels disposed therefrom for rolling the treatment cart, wherein the treatment carts have at least one sealed door to allows waste to be placed inside the treatment carts wherein at least one of the treatment carts is capable of being treated by a treatment process without having to first empty the contents of the treatment cart prior to the treatment process; and a transport container capable of being transported by a tractor trailer with an open top side and at least one opening in a side wall covered by a door wherein the transport container is capable of receiving one or more treatment carts through the opening.

2. The waste container system according to claim 1, wherein at least one of the treatment carts is capable of being treated by an autoclaving process.

3. The waste container system according to claim 1, wherein at least one of the treatment carts is capable of being treated by a microwave process.

4. The waste container system according to claim 1, wherein at least one of the treatment carts is capable of being treated by a chemical sterilization process.

5. The waste container system according to claim 1, wherein the sealed door of one or more treatment carts contains a finger disposed therefrom for engaging a rod to prevent the door from being opened.

6. The waste container system according to claim 1, wherein one or more treatment carts contains a pair of lifting channels for accepting a forks lift truck for moving the treatment cart.

7. The waste container system according to claim 1, wherein the transport container can be stacked one on top of another.

8. A waste container system comprising:

an open top rectangular roll-off transport container with a floor, a left side, a right side, a front side and a rear side with a rear door in the rear side; and one or more enclosed treatment carts with a plurality of wheels, wherein the treatment carts has at least one sealed door to allows waste to be placed inside the treatment carts, the treatment carts being so dimensioned so as to fit through the rear door to be nested together inside the roll-off transport container wherein at least one of the treatment carts is capable of being treated by a treatment process without having to first empty the contents of the treatment cart prior to the treatment process.

9. The waste container system according to claim 8, wherein at least one of the treatment carts is capable of being treated by an autoclaving process.

10. The waste container system according to claim 8, wherein at least one of the treatment carts is capable of being treated by a microwave process.

11. The waste container system according to claim 8, wherein at least one of the treatment carts is capable of being treated by a chemical sterilization process.

* * * * *